United States Patent [19]

Wendt

[11] Patent Number: 4,480,611

[45] Date of Patent: Nov. 6, 1984

[54] INTERNAL COMBUSTION ENGINE USING SEVERAL KINDS OF FUELS, WITH ELECTRONICALLY ADJUSTABLE INTAKE AND EXHAUST VALVES AND INJECTION DEVICE

[76] Inventor: Hans J. Wendt, Harburger Str. 63F, D 2150 Buxtehude, Fed. Rep. of Germany

[21] Appl. No.: 227,076

[22] PCT Filed: Apr. 19, 1980

[86] PCT No.: PCT/DE80/00053

§ 371 Date: Dec. 20, 1980

§ 102(e) Date: Dec. 19, 1980

[87] PCT Pub. No.: WO80/02308

PCT Pub. Date: Oct. 30, 1980

[30] Foreign Application Priority Data

Apr. 20, 1979 [DE] Fed. Rep. of Germany ..... 3915927

[51] Int. Cl.[3] ..... F02B 75/04

[52] U.S. Cl. ..... 123/197 C; 123/19; 123/46.5 C; 123/78 R

[58] Field of Search ..... 123/46 SC, 78 R, 78 E, 123/78 F, 197 R, 197 AC, 197 C, 19, 2, 46 E, 54 A

[56] References Cited

U.S. PATENT DOCUMENTS

| | | | |
|---|---|---|---|
| 891,350 | 6/1908 | Mascord | 123/197 R |
| 1,512,879 | 10/1924 | Corniere | 123/197 C |
| 1,671,796 | 5/1928 | Tracey | 123/46 SC |
| 2,482,136 | 9/1949 | Wright | 123/197 C |
| 3,853,100 | 12/1974 | Braun | 123/46 SC |
| 4,173,951 | 11/1979 | Ishihara | 123/2 |
| 4,205,638 | 6/1980 | Vlacancinch | 123/19 |

FOREIGN PATENT DOCUMENTS

| | | |
|---|---|---|
| 2456957 | 5/1976 | Fed. Rep. of Germany . |
| 2612961 | 10/1977 | Fed. Rep. of Germany . |
| 2720171 | 11/1978 | Fed. Rep. of Germany . |
| 2845351 | 5/1979 | Fed. Rep. of Germany . |
| 2257783 | 8/1975 | France . |
| 2271398 | 12/1975 | France . |
| 2339748 | 8/1977 | France . |
| 189717 | 3/1937 | Switzerland . |

*Primary Examiner*—Craig R. Feinberg
*Assistant Examiner*—W. R. Wolfe
*Attorney, Agent, or Firm*—Andrus, Sceales, Starke & Sawall

[57] ABSTRACT

The combustion engine using several kinds of fuels is provided with intake and exhaust valves and an injection device which may be electronically adjusted. It is comprised of at least one working cylinder (1, 1*a*) at the upper part of which is provided a fuel supply device (4), an intake valve (5) and an ignition device (6); these elements being all electronically adjustable. In the working cylinder (1, 1*a*) there is provided a piston (9) which is in communication with a pressure accumulator device. This connection device may be comprised of a hydraulic, pneumatic accumulator or even a spring accumulator. The piston rod (12), provided with a blocking device (11) is connected to a transmission shaft (15), (15*a*). To regulate the running of this engine, there is provided an indicator (3) of the cylinder temperature, a piston position indicator (34) and an electronically programmable adjusting and control device (20), such device (20) possibly being a microprocessor (20*a*). The control and adjusting device (20) has a display unit (51); this device (20) is connected with the temperature indicator (3), the piston position indicator (34) and, via a switch (21), with the fuel supply device (4) and the intake valve (5).

19 Claims, 19 Drawing Figures

ENGINE WORKING STROKE PROGRAM

INTERNAL COMBUSTION ENGINE USING SEVERAL KINDS OF FUELS, WITH ELECTRONICALLY ADJUSTABLE INTAKE AND EXHAUST VALVES AND INJECTION DEVICE

BACKGROUND OF THE INVENTION

The invention relates to an internal combustion engine using several kinds of fuels with electronically adjustable intake and exhaust valves and injection device. This internal combustion engine can be used wherever engine drive units are required. It can be used as a drive for vehicles, cranes, excavators, etc in which the drive unit must be designed for different loads and must be able to use different kinds of fuel.

An internal combustion engine for using different types of fuel with electronically adjustable intake and exhaust valves on an electronically controllable injection device is already known from DE-OS Nos. 2,612,961 and 2,720,171.

These known electronically controlled internal combustion engines operate with a closed hydraulic circuit replacing the crankshafts hitherto conventionally used on such engines. This makes it possible to use a substantially electronic sequence control from the standpoint of minimizing the number of cylinders used and the partial recovery of the braking energy, whilst substantially replacing the gear. However, this known engine has the disadvantage of relatively expensive hydraulics which, particularly in the case of the construction of low power engines in large numbers, such as vehicle engines, increases the cost of production due to the use of hydraulic components. In addition, limits are placed on such an engine in the case of higher numbers of strokes or revolutions, because with higher flow rates in the hydraulic fluid the efficiency decreases due to internal friction.

In addition, an internal combustion engine is known in which the complete camshaft mechanism of a four-stroke Otto engine is replaced by a valve gear controlled by a microprocessor. Although this engine has the advantage of an electronically controlled valve mechanism, it has the decisive disadvantage of being linked with a costly crankshaft with a multicylinder arrangement. As a result of this crankshaft surface and the associated fixing to a top and bottom dead centre variable compression and the associated mixed Otto or diesel operation and the possibility of using different fuels in the same engine cannot be obtained. In addition, this known engine does not provide the possibility of substantially eliminating the gear and coupling with a braking energy recovery accumulator.

BRIEF SUMMARY OF THE INVENTION

Object of the invention is to provide an electronically controlled combustion engine which, as a result of technologically simple construction, can also be economically produced for low output levels and which, compared with hitherto known similar combustion engines has a better efficiency, even with greater numbers of strokes and revolutions.

According to the invention, this problem is solved by an internal combustion engine with at least one working cylinder at the top of which are arranged an electronically adjustable intake valve and an electronically adjustable ignition device and in which is located a piston in operative connection with a compression-storing mechanism, whose piston rod, which can be secured by a retaining device, is connected by means of power-transmitting means to a driven shaft, a temperature indicator for the cylinder temperature and a piston position indicator and a programmable electronic regulating and adjusting device with a display unit which is in operative connection with the temperature indicator, the piston position indicator, the electronically adjustable intake valve and, via an electrical circuit breaker, with the electronically adjustable fuel intake device.

The incorporation of the electromechanical working circuit provides advantages such as the minimizing of the number of cylinders, variable compression, mixed diesel or Otto operation, omission of the crankshaft and the mechanical valve mechanism associated therewith, the partial recovery of braking energy, a substantial elimination of a gear, etc, in the manner already known in connection with an electronically controlled internal combustion engine with a hydraulic working circuit. The replacement of the complicated and costly crankshaft with connecting rod and connecting rod bearings by a simple, rigidly guided rack with driven pinions according to a special feature of the invention increases the service of the internal combustion engine and permits several spatially different arrangements of the working cylinder.

In addition to the possibility of using several different liquid fuels, the internal combustion engine according to the invention also makes it possible to use gaseous fuels as the drive means. Further features and developments of the invention are described in the claims forming the terminal portion of this specification.

BRIEF DESCRIPTION OF THE DRAWINGS

The invention is described in greater detail hereinafter relative to non-limitative embodiments and the attached drawings, which show.

DETAILED DESCRIPTION OF THE PREFERRED EMBODIMENTS

Figure 1:
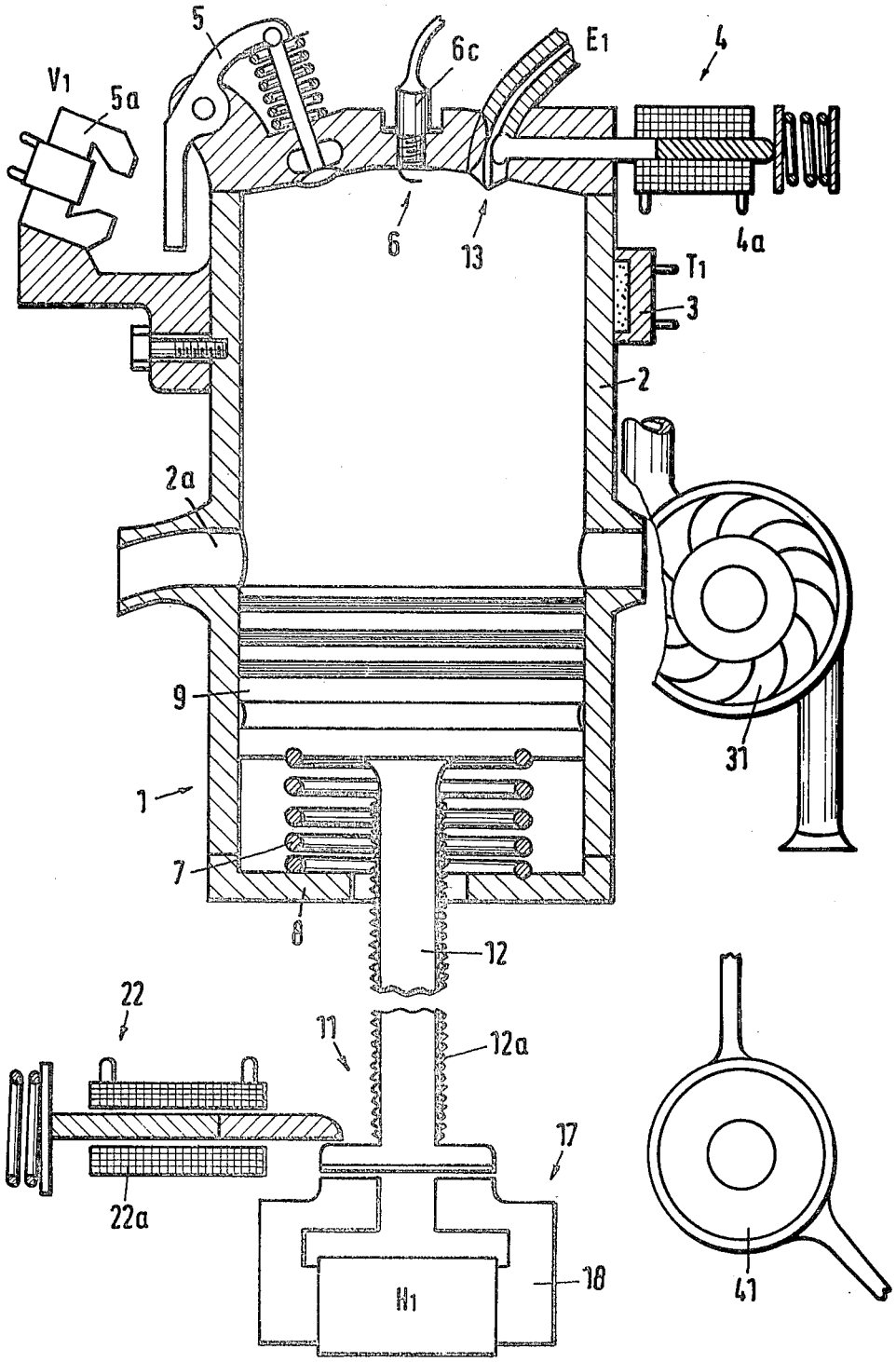
FIG. 1 a working cylinder of the internal combustion engine according to the invention with the associated electromechanical devices in a diagrammatic side view.

FIG. 1 shows the construction of the combustion part and the electromechanics of the electronic internal combustion engine according to the invention in diagrammatic manner with respect to the example of a working cylinder 1 with piston 9. The mechanically very simple form of a directly injecting internal combustion engine with uniflow or separate scavenging by the compressor 31 through intake valve 5 and exhaust slot 2*a* has been chosen. However, in the case of this engine, it is also possible to use intake and exhaust valves, as well as a carburettor means in place of the electronic injection device 4. However, the directly injecting internal combustion engine with intake valve 5 and exhaust slots 2*a* constituted a mechanically very simple form of an internal combustion engine 10 with a high efficiency. Internal combustion engine 10 comprises one or more cylinders 1, 1*a* with electronically adjustable intake valves 5, electronic fuel intake devices 4, electronic ignition devices 6 and temperature indicators 3 for the cylinder wall temperature. Cylinder 1 is positioned above the lower position of the exhaust slots 2*a* which expose the piston 9 movable therein. The bottom of piston 9 is supported against a compression spring 7 arranged on the cylinder bottom 8 and serves to absorb the compression energy required for the compression stroke. The piston shaft 12 rigidly connected to piston 9 is constructed on both sides as a rack 12*a* and is guided between driven pinions 14. At the lower end portion of piston shaft 12 is provided yoke 17 for solenoid 18. On switching on, the latter has the function of maintaining piston 9 in the lower position counter to the tension of compression spring 7. A locking magnet 22 serves to permanently secure piston 9 counter to the tension of compression spring 7 when internal combustion engine 10 is switched off. FIG. 1 also shows the electromotive compressor 31 used for uniflow scavenging and the electronically operated injection pump 41.

Figure 2A:
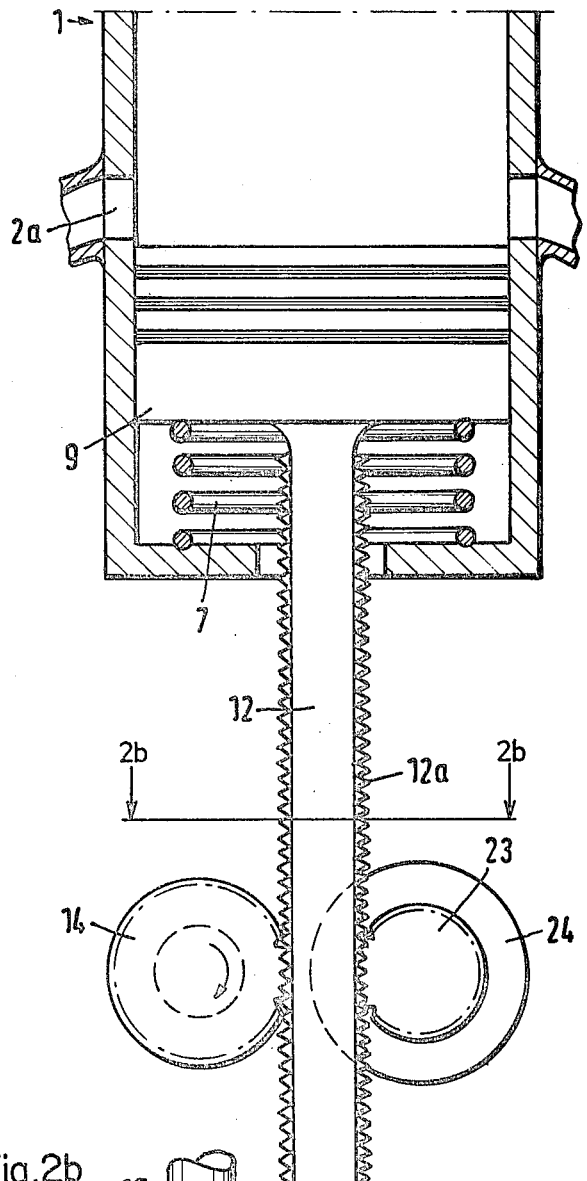
FIG. 2*a* a further representation of the working cylinder of FIG. 1 in cutaway form with the power-transmitting devices in a diagrammatic side view.
Figure 2B:
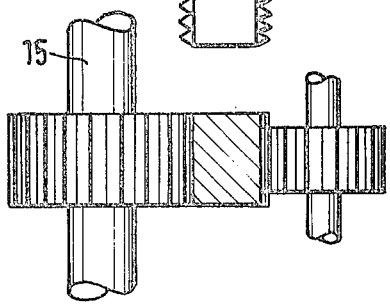
FIG. 2*b* is a cross sectional view taken along the line 2*b*—2*b* of FIG. 2*a*.

As shown in FIG. 2, gears 23 are connected to piston shaft 12 constructed in the form of rack 12*a*, one of said gears being connected to the electrical motor/generator 24, whilst the other, as the driven pinion 14, is connected to the driven shaft 15.

Figure 3:
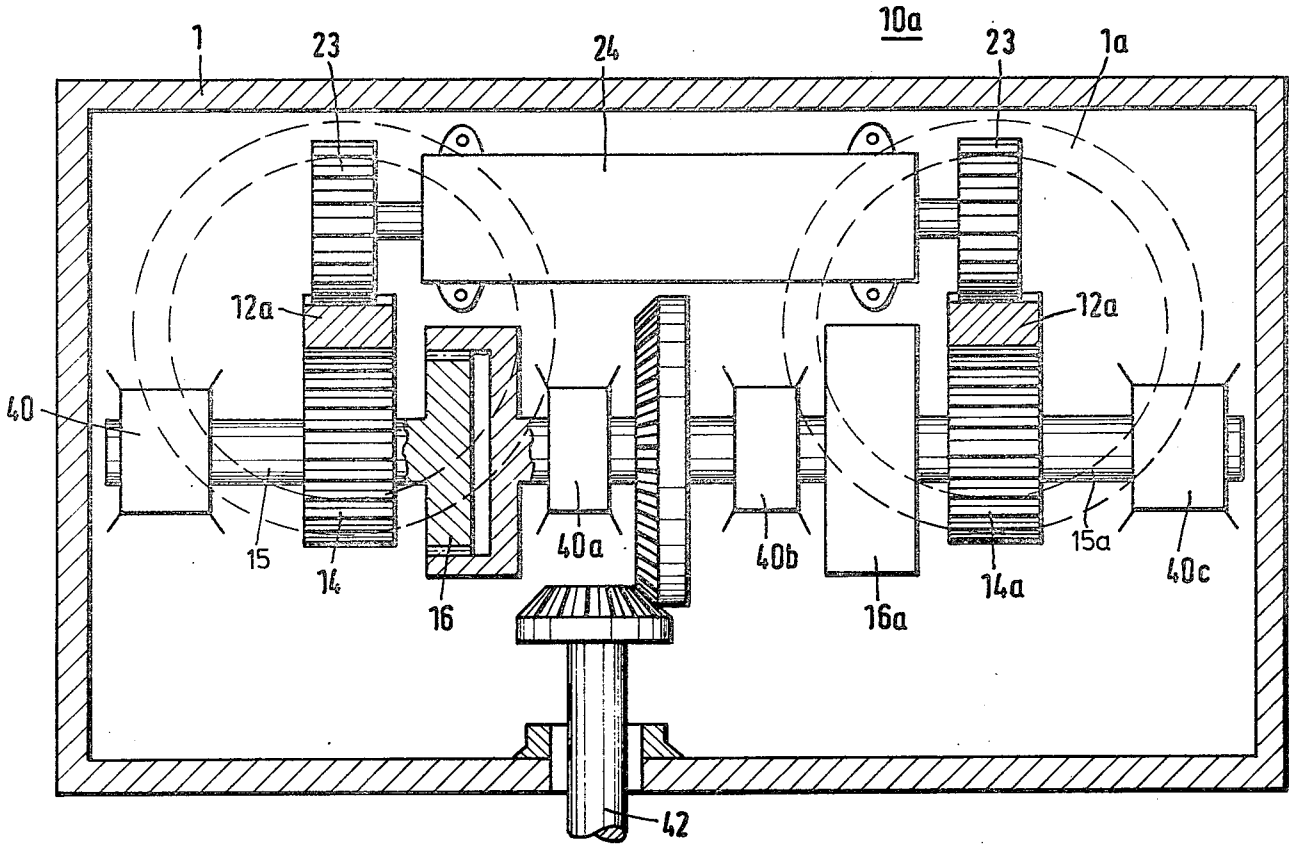
FIG. 3 a two-cylinder internal combustion engine in a sectional view from below.

FIG. 3 shows a cross-section through the casing of an internal combustion engine 10*a* with two cylinders 1, 1*a*. The driven shaft 15 and the driving shaft 42 are in operative connection with the piston 9 located in working cylinders 1, 1*a*. An electrical motor/generator 24 arranged in a common casing is provided for each of the two working cylinders 1, 1*a*, and as a result of an alternately operating, not shown circuit breaking electronics can be used as a starting motor for moving piston 9 into the compression position or as a generator during the working stroke of engine 10, 10*a*. Two free wheels 16, 16*a* arranged on the driven shaft 15, 15*a* of the particular working cylinders 1, 1*a* make it possible to drive the driven shaft 15, 15*a* for the working stroke and release the driven shaft 15, 15*a* with an oppositely directed compression movement.

Figure 4A:
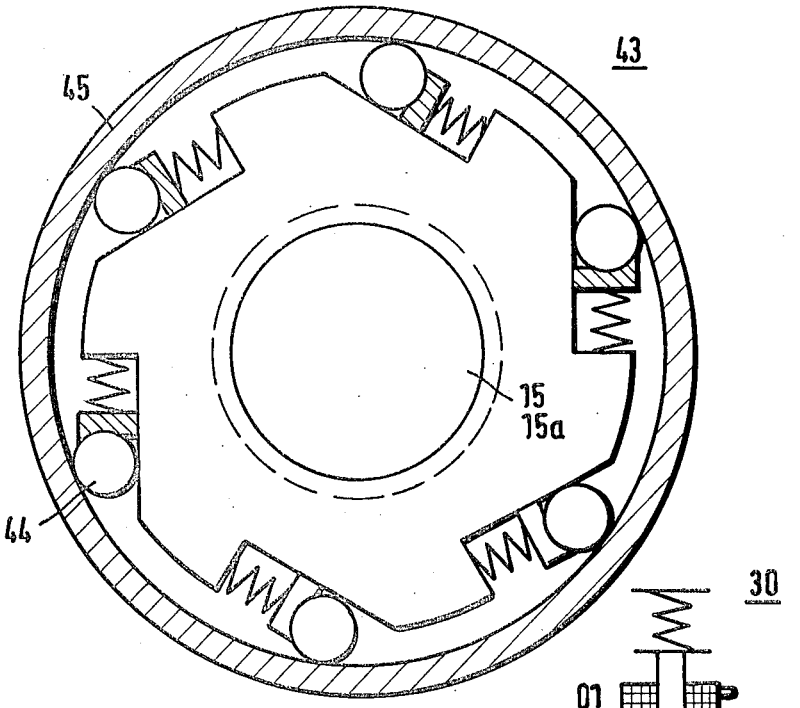
FIG. 4*a* a free wheel for the driven shaft in a sectional side view.

FIG. 4*a* shows an example of a free wheel 16, 16*a* in operative connection with the driven shaft 15, 15*a* relative to a mechanical grip roller free wheel 43 in which the grip rollers 44 are arranged in spring-guided manner between driven shaft 15, 15*a* and the driven outer cylinder 45.

Figure 4B:
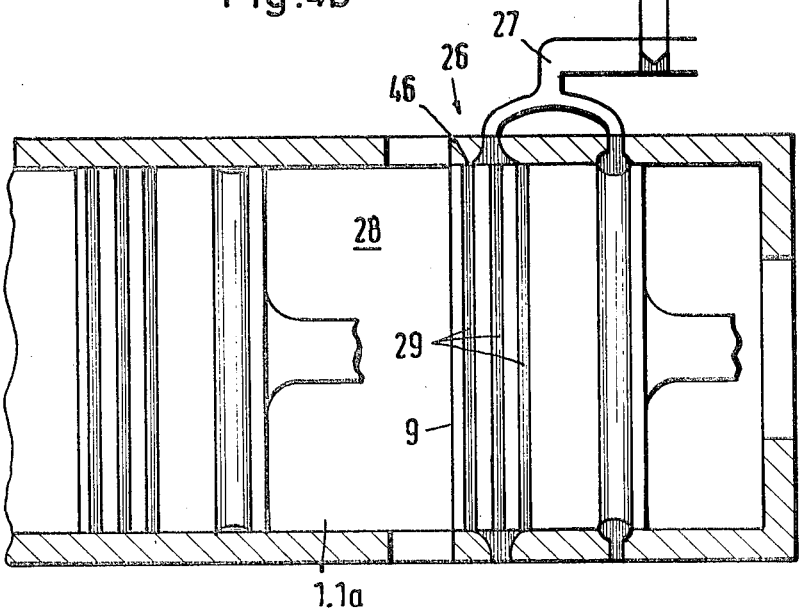
FIG. 4*b* the construction of the lubrication system for the piston/cylinder arrangement.

An advantageous construction of the pressure oil lubrication system is shown in FIG. 4*b* in which oil lubrication grooves 46 in cylinder walls 2 are linked with a pressure oil line 27 and supply pressurized oil to a ring lubricating groove 29 formed in the lower part of piston 9.

Figure 5:
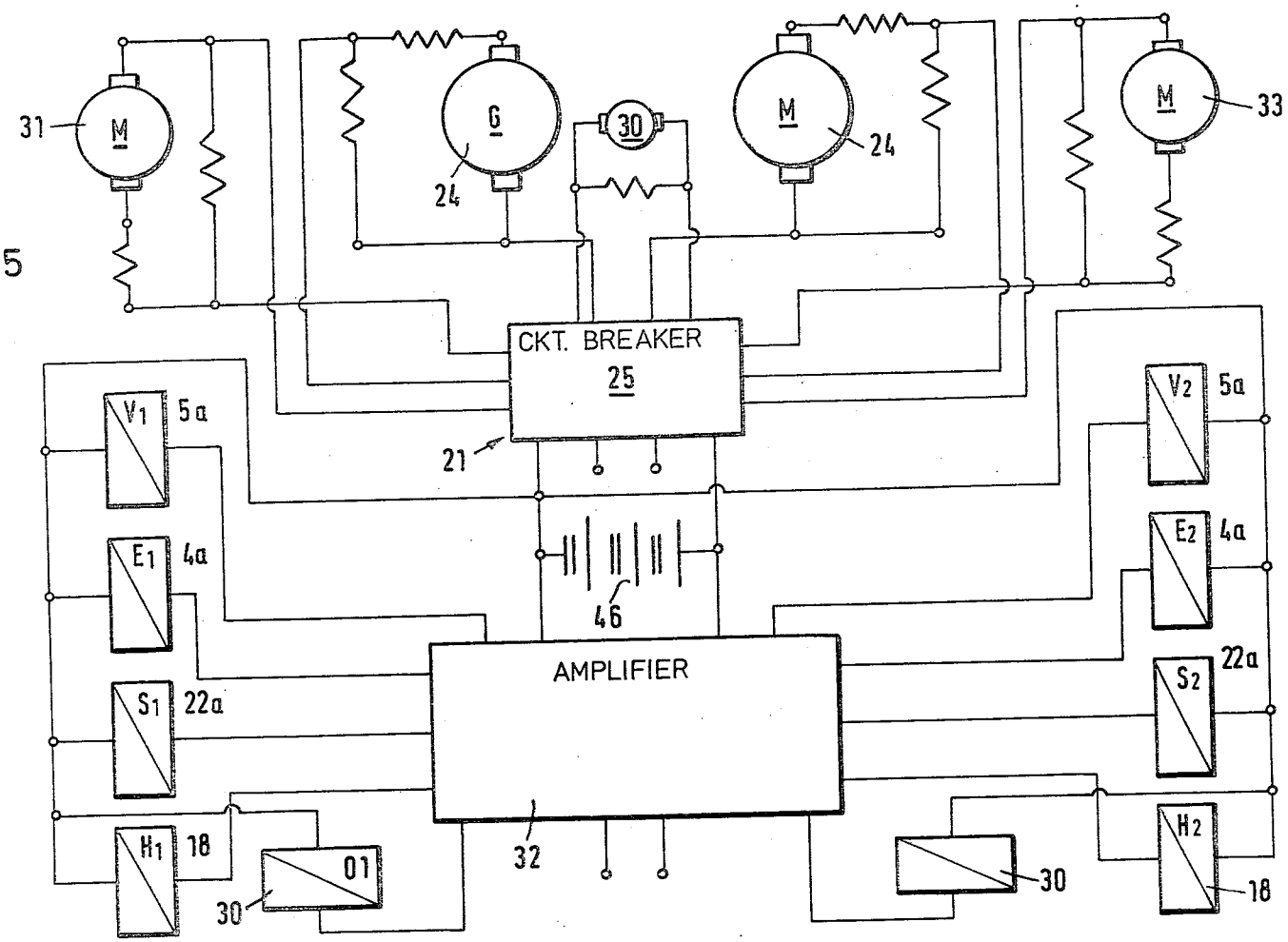
FIG. 5 a circuit diagram of the electrical device for the internal combustion engine.

FIG. 5 shows the electronic part of the electronically controlled internal combustion engine 10, 10*a* with electromechanical working circuit. It essentially comprises an amplifier 32 for the field coils of control valves 5 and solenoids 5*a*, 4*a*, 22*a*, 18 and 30*a* of cylinders 1, 1*a* supplied by the electronic adjusting and control device 20, see FIG. 7, with the actuating commands for the particular control parts.

There is also a circuit breaker 25 which in turn switches the electrical motor/generators 24 for cylinders 1, 1*a* from generator to motor operation and vice versa. Circuit breaker 25 also switches on or off the electric motors for compressor 31, oil pump 30 and injection pump 41. This is brought about by control commands emanating from the electronic adjusting and control device 20. The motor/generators 24 used here can, for example, be direct current units either operated by a common starter battery 46 or charge the latter. The motors for compressor 31, oil pump 30 and injection pump 41 can also be direct current motors.

Figure 6A:
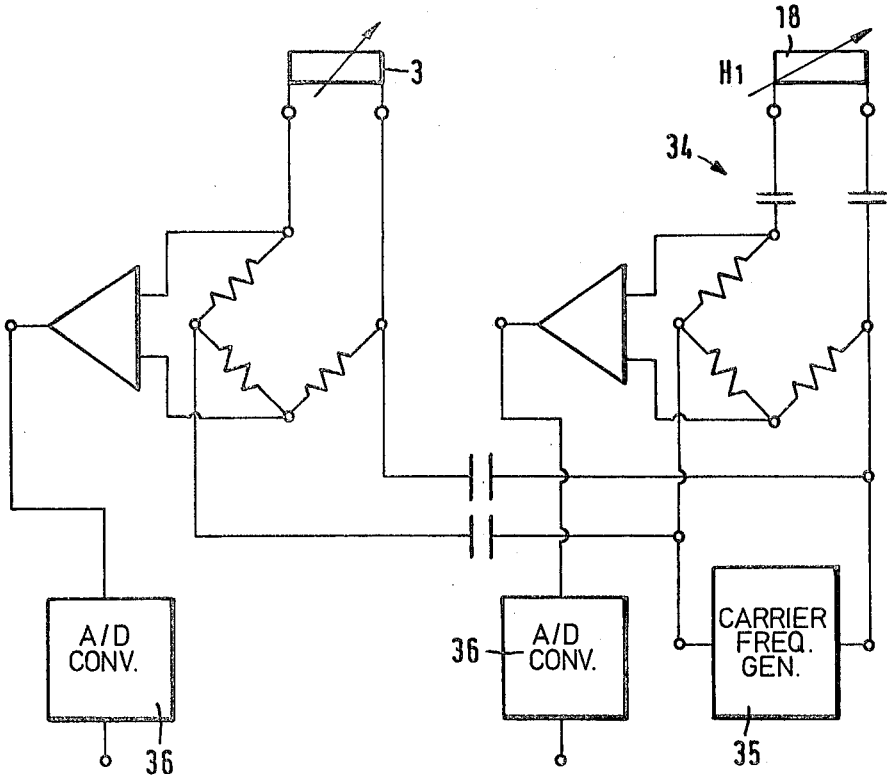
FIG. 6*a* the circuit diagram of a piston position indicator and a temperature indicator.
Figure 6B:
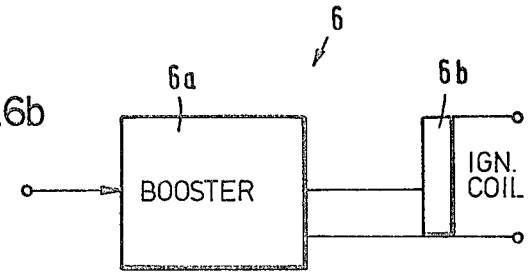
FIG. 6*b* the connection of the ignition coil and booster in a diagrammatic view.

FIG. 6 shows the piston position indicator 34 the temperature indicator and the ignition device 6. The piston position indicator 34 and temperature indicator 3 are operated with a.c. voltage from a carrier frequency generator 35. Its signals are measured in analog manner and transmitted via an analog-digital converter 36 to the electronic adjusting and control device 20. The piston position indicator 34 is the coil of solenoid 18 within the framework of an inductive a.c. bridge. The booster 6*a* receives ignition pulses from the electronic adjusting and control device 20, boosts them and transfers them via ignition coil 6*b* to the spark plug 6*c* of the particular cylinder 1, 1*a*.

Figure 7:
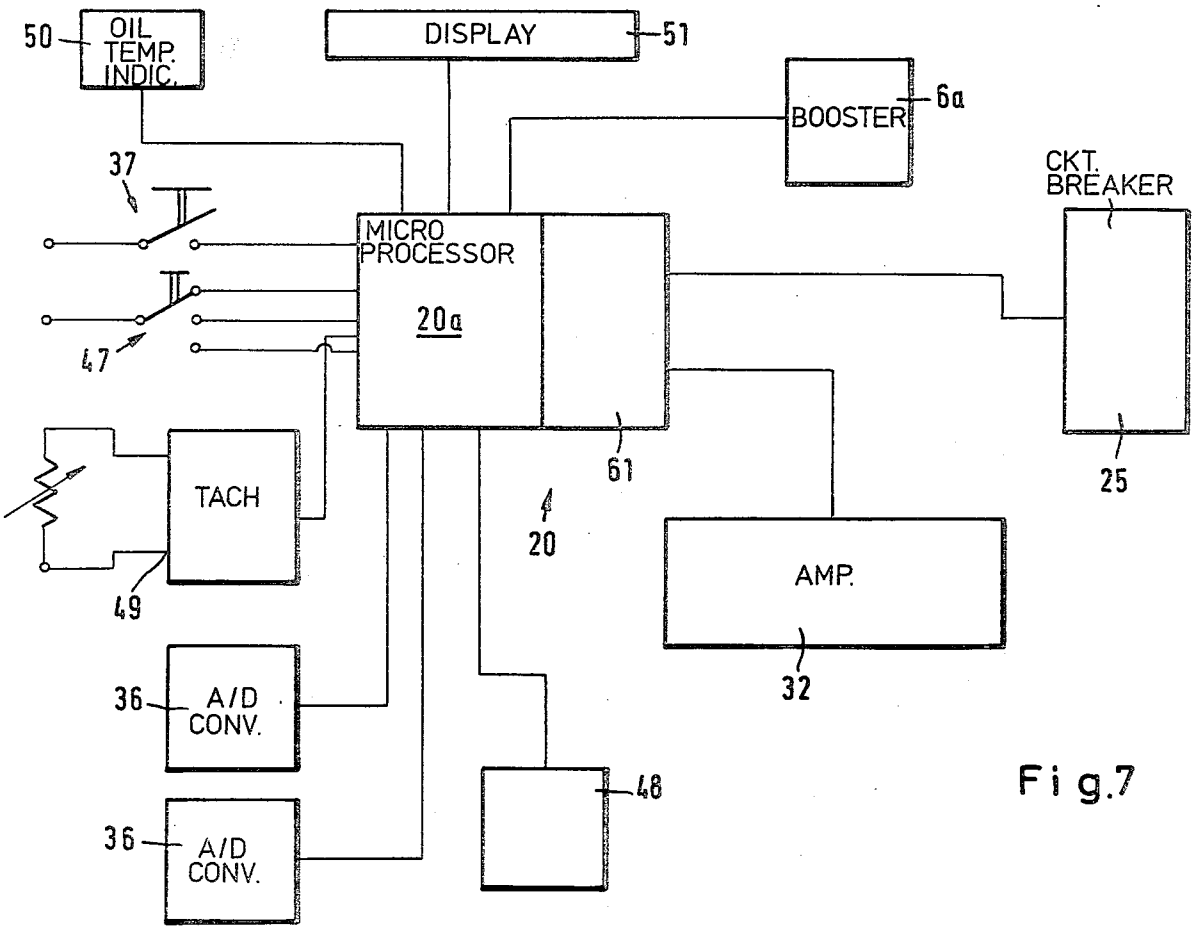
FIG. 7 a block circuit diagram of the electronic control unit.

The electronic adjusting and control device 20 can be formed by a microprocessor 20*a* (FIG. 7). It is switched on and off by means of a starting switch 37 and controls all the functions of working cylinders 1, 1*a* essential for the operation of the internal combustion engine 10, 10*a*. An operating mode switch 47 makes it possible to select different acceleration functions, as well as indicating the fuel used and the desired operating mode, e.g. Otto or diesel operation. Microprocessor 20*a* is connected to a display unit 51 which displays, in addition to the input data, concerning the desired acceleration, fuel type and diesel or Otto operation, the desired number of strokes or revolutions predetermined by the tachometer of stroke counter 49. In addition, additional data are displayed such as the quantity of fuel consumed per unit of time and when the internal combustion engine 10 is used in motor vehicles the travelling speed reached, the torque, the engine and/or oil temperature by means of oil temperature indicator 50. It is also possible to show other information such as e.g. the fuel supply, oil consumption or supply and possibly maintenance data. A position sensor 48 informs the microprocessor 20*a* whether the vehicle is moving horizontally, uphill or downhill. This makes it possible to determine the optimum starting moment. The booster 6*a*, circuit breaker 25 and amplifier 32 are supplied during operation with the addressed control signals of microprocessor 20*a*. These units are in each case associated with a working cylinder 1, 1*a*.

Figure 8:
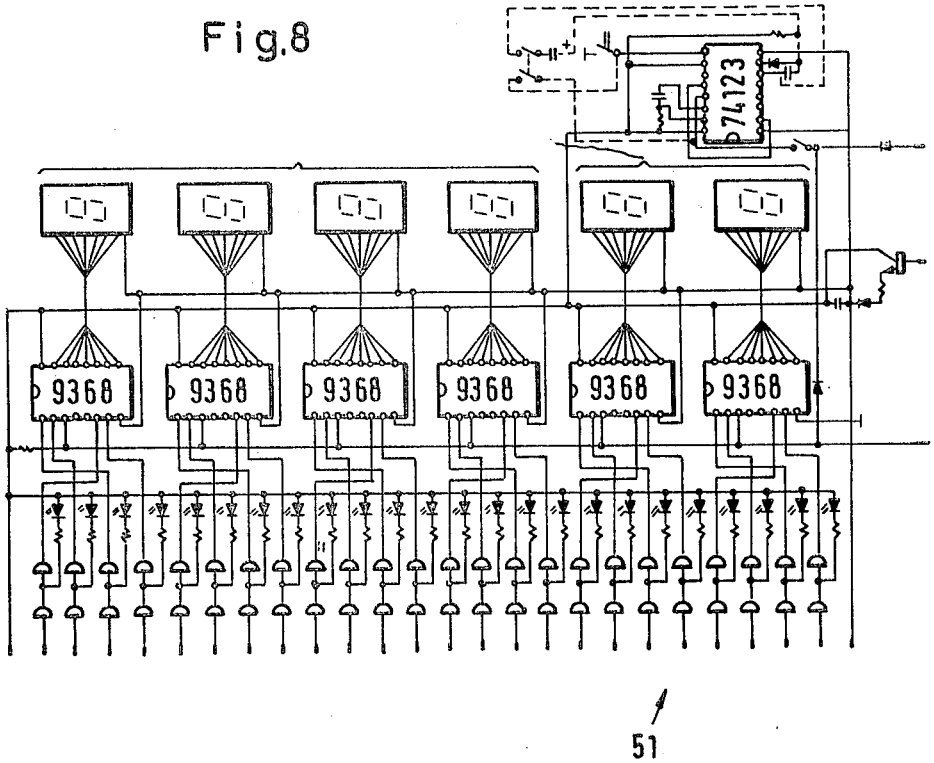
FIG. 8 the circuit diagram of the multi-position display unit.

FIG. 8 shows the example of a circuit diagram for the multi-position display device 51 in operative connection with the microprocessor 20*a*. The addressed indicating or display signals from microprocessor 20*a* are decoded by integrated decoder components, e.g. of type 9368 and supplied to so-called seven-segment displays, e.g. of type HA 1143. Display device 51 functions directly at the data bus of microprocessor 20*a*. In the case of direct addressing, a not shown address decoder transmits the data content of the microprocessor data bus to display device 51. The present display device 51 makes it possible to display word lengths of up to 16 bits. The inputs of display device 51 comprise invertable hexadecimal buffers which do not load the data bus. The outputs of the hexadecimal buffers lead directly to the binary-hexadecimal decoder components of type 9368, which convert the digital code to the display code of the following hexadecimal LED displays of type HE1143. As a result, the data content of data bus of microprocessor 20*a* can be represented by seven-segment digital displays.

Figure 9:
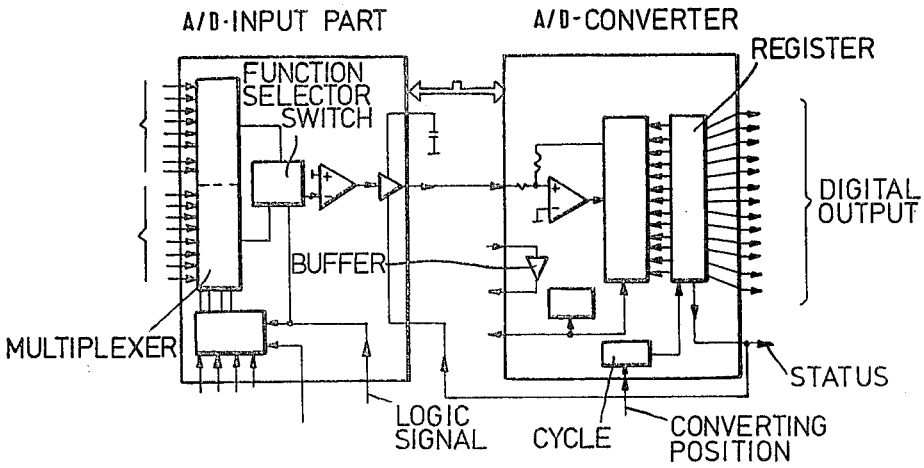
FIG. 9 the circuit diagram of an analog-digital converter used with the piston position indicator and the temperature indicator.

FIG. 9 shows the circuit diagram of an analog-digital converter used in the piston position indicator 35 or the temperature indicator 3. This analog-digital converter 36 is of the AD 363 type. It comprises an analog input part and the converter part. Its digital output signal is switched to microprocessor 20*a*. The analog input signals are switched by means of high or low-impedance inputs to the multiplexer of the analog input side. The latter queries the signal level at the inputs and stores the values in the intermediate store or transmits them via the switching unit to the following amplifier. The d.c. analog output of the amplifier passes to the actual AD converter. Parallel thereto is the signal at the comparator, which supplies the reference voltage for the converting process in AD converter 36. Starting from the AD converter output, the digitized signal passes to a register by which it can be made ready for the data bus of microprocessor 20*a*.

Figure 10:
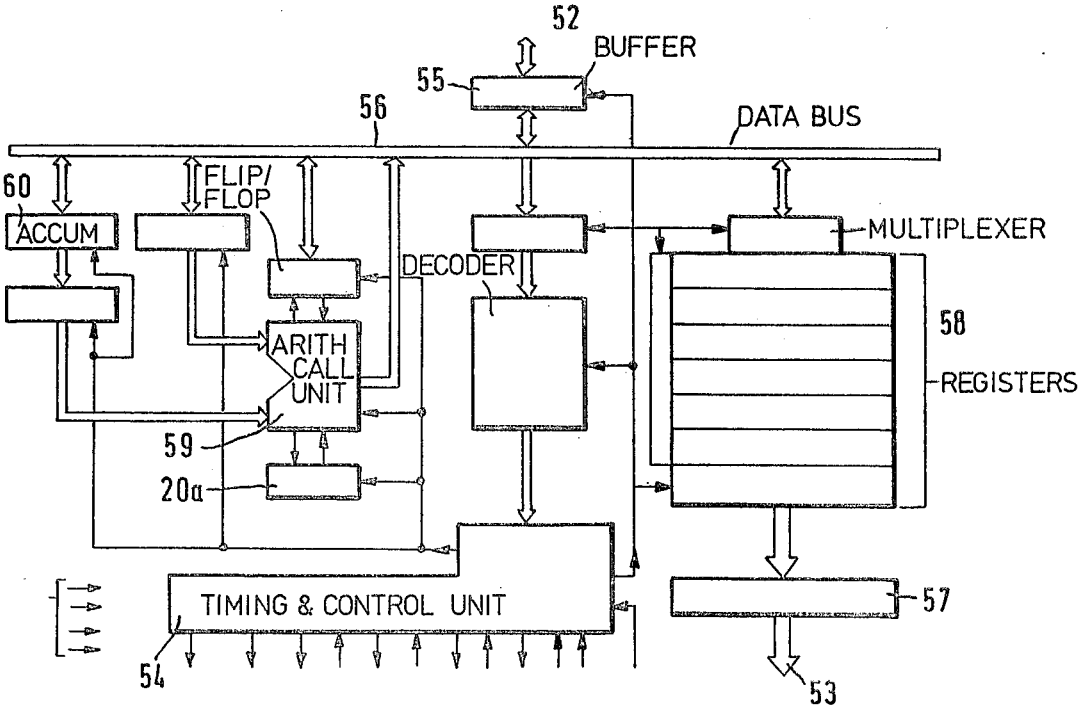
FIG. 10 the circuit diagram of a microprocessor associated with the electronic control unit.

The internal construction of the microprocessor 2*a* used in the adjusting and control device 20 is shown in FIG. 10. The microprocessor 20*a* is of type 8080. It is connected by means of a two-way data bus 52 as the interface with the following units. An address bus 53 is used for addressing purposes. An internal eight-bit data bus 56 takes over the data transmission between the individual components such as e.g. registers 58 and accumulators 60, together with the arithmetic calculating unit 59, etc. The entire peripheral data transmission is carried out by means of the two-way data bus 52, which is cyclically controlled by the time and control unit 54 and is linked via the data bus buffer 55 and locking means with the internal data bus 56 of microprocessor 20*a*. The associated address bus 53 for the peripheral addressing of address buffer 57 is operated by the timing and control unit 54 via the address locking means. The core of microprocessor 20*a* is formed by the timing and control unit 54, which cyclically controls the arithmetic calculating unit 59, the decimal adjustment means 61, the store and the register arrangement. The internally stored command structure of microprocessor 20*a* is laid down and stored in the register arrangement. The arithmetic calculating unit 59 functions via accumulator 60 as an intermediate store and via the internal data bus 56 cooperates with the register arrangement. It receives the programme sequence structure from the register arrangement and processes the existing working orders.

Figure 11:
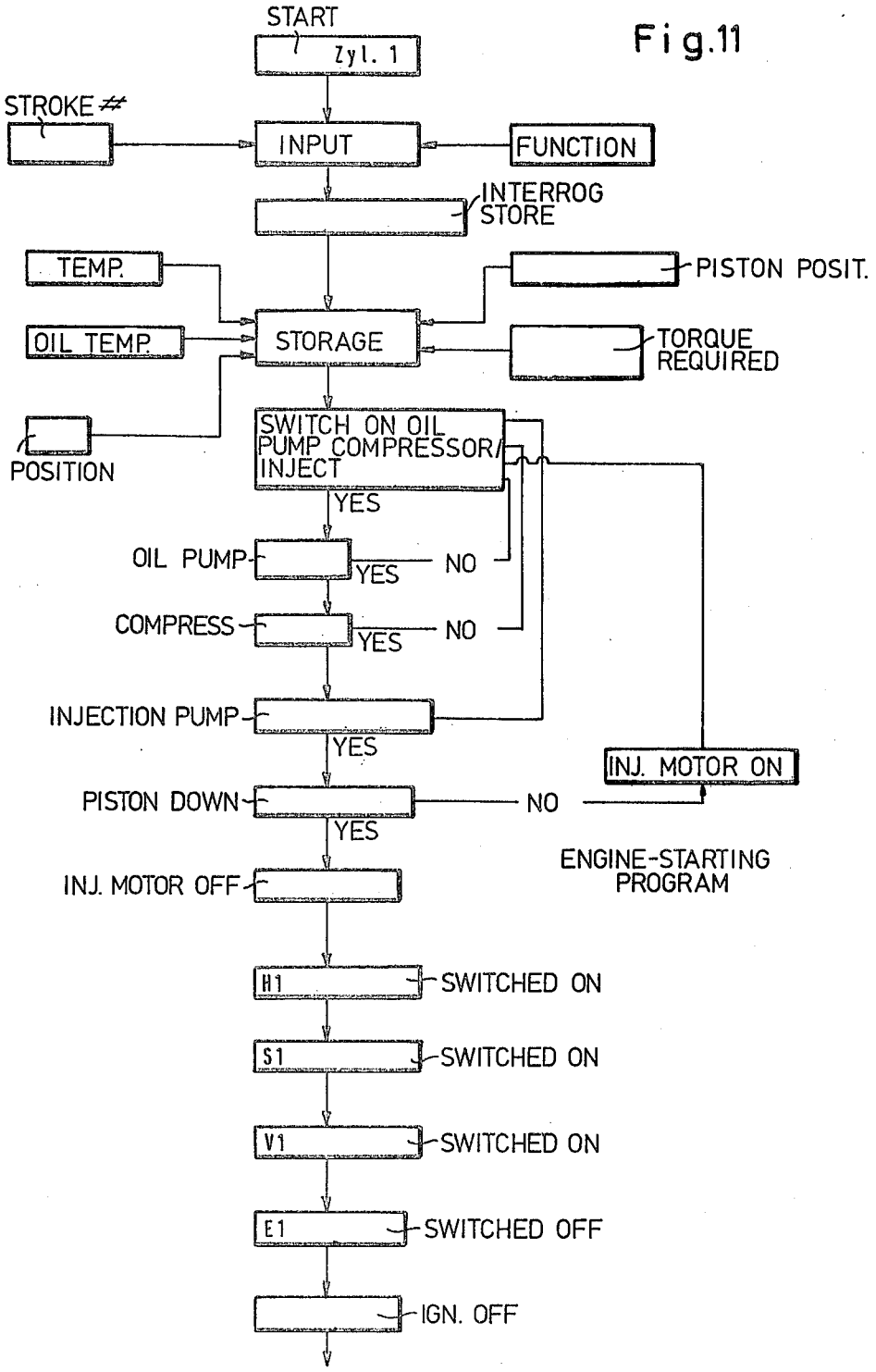
FIG. 11 the flow chart of an engine starting programme.
Figure 13:
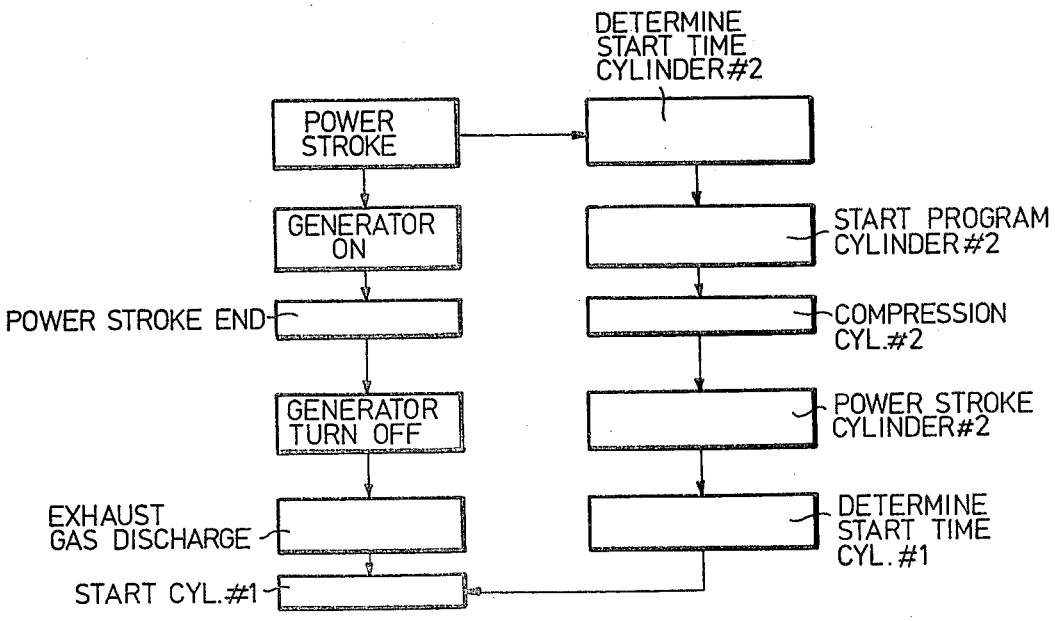
FIG. 13 the flow chart of the engine working stroke programme.

The programme sequences stored in microprocessor 20*a* are represented in the flow charts of FIGS. 11 and 13. The programme sequence is subdivided into three partial programmes, namely the engine starting programme, the engine compression programme and the engine working stroke programme. The programmes are built up in such a way that on the basis of the input data and predetermined values, they cyclically match the working sequence of working cylinders 1, 1*a* to one another and control the engine output, as well as the number of revolutions or strokes to the desired data values.

Figure 14:
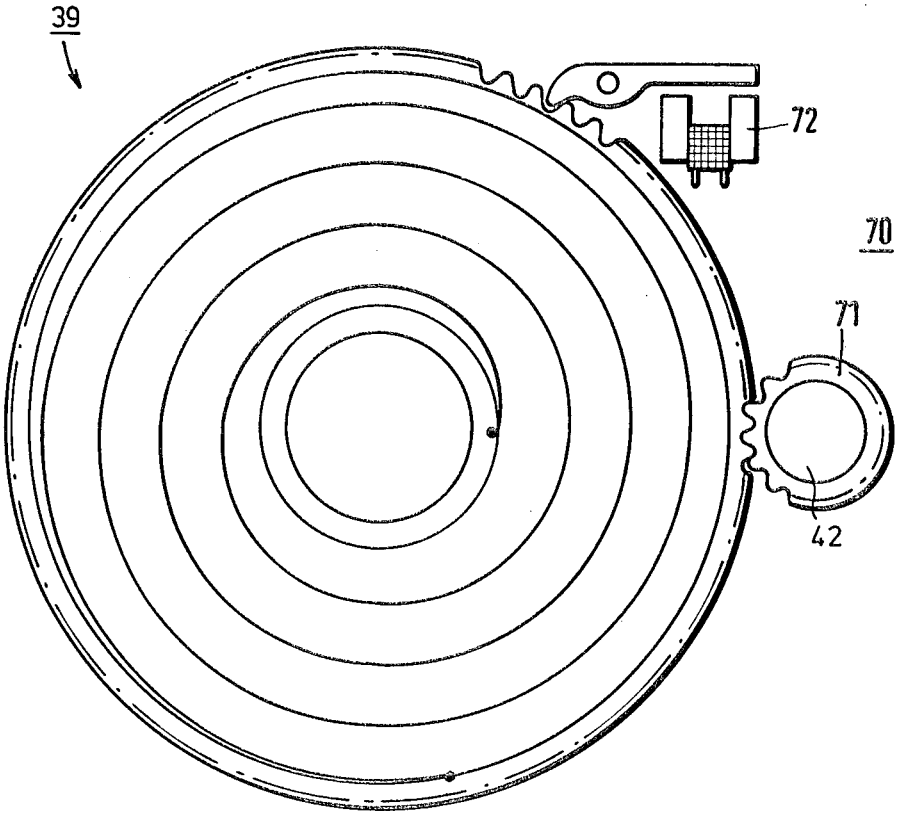
FIG. 14 a diagrammatic view of the construction of a mechanical spring accumulator for absorbing the braking energy.

FIG. 14 shows a mechanical spring accumulator 70 for absorbing the braking energy when the internal combustion engine 10, 10*a* is used in vehicle operation. Accumulator 70 is connected via a special coupling arrangement with the driving shaft 42 and during the braking process is used for absorbing braking energy via the electronic adjusting and control device 20 on the one hand or for supplying accelerating energy on the other. Alternatively, by means of a hydraulic coupling, it is possible to operate the hydraulic storage means shown in DE-OS No. 2,720,171 for braking energy recovery in conjunction with internal combustion engine 10, 10*a*.

By means of the description of a sequence, it is shown hereinafter how the electronically controlled internal combustion engine 10, 10*a* with the electromechanical working circuit can function within the different sequence phases and is coordinated and controlled with optimum efficiency with the aid of the electronic adjusting and control device 20.

The predetermined operating data are defined in the storage of microprocessor 20*a* of the electronic adjusting and control device 20. These operating data consist of the values stored in table form for different speed-torque characteristics and the associated fuel consumption quantitites. These values correspond to a number of predetermined curves corresponding to the in each case highest power ratio, i.e. the maximum throttle response and consequently represent the maximum power and fuel consumption limit. However, the lowest curve represents a moderate throttle response with minimum fuel consumption. Further parameters for preparing the fuel mixture and ensuring the ignition quality of the fuel on starting are the oil and cylinder temperature which, via the corresponding sensors of the oil temperature indicator 50 and temperature indicator 3, optimize the carburetion for the cold and the hot running engine. When used in a motor vehicle an electronic position sensor 48 gives information on the necessary minimum starting moments for uphill, downhill or horizontal travel. An operation mode selection switch 47 informs the microprocessor 20*a* on whether Otto or diesel operation is being used and also on the type of fuel used. The tachometer or stroke counting 49 serves to predetermine the desired speed values to be reached in operation. However, when used in a vehicle, it can also be employed as a speedometer.

As a result of the possibility of starting under load without a gear, the electronically controlled combustion engine 10, 10*a* is able to obviate the need for an idling speed such as is required with a crankshaft unit. On switching on the starting switch 37, engine 10, 10*a* is ready to operate. In accordance with the starting programme according to FIG. 11 for this purpose, compressor 31, oil pump 30 and injection device 6 are switched on. In addition, the locking magnet 22 and solenoid 18 are switched on and brought into the hold position. If for any reason the piston 9 is not in the bottom position, e.g. due to ignition not having taken place, it is brought into this position by switching on the electric motor/generator 24 and solenoid 18. The compression programme according to FIG. 12 can now take place in the internal combustion engine 10, 10*a*.

On switching on valve magnet 5*a* the associated valve 5 is opened and the cylinder chamber is scavenged with fresh air. The necessary injection quantity is determined and the injection time fixed from the predetermined values of the storage of microprocessor 20*a* on the basis of the predetermined torque, the engine temperature and the air charge quantity, determined by the intake pressure and the available cylinder volume. The time of starting uniflow or separate scavenging is determined from the predetermined operating time-Otto or diesel operation. The values determined as a result of this are made available by storage read-out. By switching on the pressure oil valve O, lubricating oil is supplied via pressure oil pump 30 to the ring lubricating groove 29 of piston 9. The actual compression process starts with the switching off of solenoid 18 and pressure oil valve O. This is brought about by the energy stored in compression spring 7 bringing piston 9 into the compression position. Solenoid 18, which is simultaneously connected by its coil as a piston indicator 34 into a Wheatstone a.c. bridge, in this case serves as piston position sensors. This modifies its a.c. resistance as a function of the air gap size between the magnet core and the yoke which is dependent on the piston position and consequently generates a variable a.c. voltage. A corresponding level of the input a.c. voltage at the amplifier and analog-digital converter 36 according to FIG. 6 is associated with each piston position. Thus, microprocessor 20*a* of the electronic adjusting and control device 20 is able to determine the movement of piston 9 in cylinder 1, 1*a* during the compression process and the working stroke. However, it is alternatively also possible to use here other piston travel determination processes, such as e.g. d.c. resistance measurement, as well as magnetic, optical or high frequency distance measuring processes.

In turn, microprocessor 20*a* is now in a position to determine the correct injection time and the optimum ignition time in accordance with the predetermined data. This is brought about by switching on and off injection valve 4*a*, as well as ignition device 6 in the case of applied ignition. As to whether the internal combustion engine 10, 10*a* has fired and the operating stroke has begun, is recognised by the electronic testing and control device 20 from the reversal of the movement process of piston 9 for the piston position indicator 34. If firing has not taken place, the electronic motor/-generator 24 of FIG. 2 can return piston 9 to the starting position from where a further starting and compression process can commence. The start of the working stroke, defined by the reversal of the piston movement after ignition, simultaneously serves for determining the starting process for the further cylinder 1*a*, the start of whose working stroke following the same releases the working stroke programme for the first cylinder. Thus, two cylinders 1, 1*a* work together on the same driving shaft 42 through the programme sequence of microprocessor 20*a* of electronic adjusting and control device 20. To increase output, it is also conceivable to either successively or parallel-link further cylinders in said programme sequence. The final stage in the working stroke programme is the automatic exhausting of the hot exhaust gases by exit slots 14.

If when the electronically controlled combustion engine 10, 10*a* is used in a vehicle, the braking energy accumulator 39 according to FIG. 14 is to be used, the latter is connected with driving shaft 42 by means of a special coupling 71 during the braking process. In this case, the electronic adjusting and control device requires a signal from the brake pedal, which indicates the start of the braking process. It then brings about the coupling in of the spring accumulator 70, which has an electronic measuring device indicating to the electronic adjusting and control device 20 how much braking energy is available in spring accumulator 70. In the case of acceleration, spring accumulator 70 is connected with driving shaft 42 by coupling 71 and the electronic adjusting and control device 20, so that the stored energy can be supplied to driving shaft 42. Spring accumulator 70 has an electromagnetically operable barrier 72, so that the stored energy can be retained for a random period. This barrier 72 is, if necessary, released by the electronic adjusting and control device 20.

Figure 12:
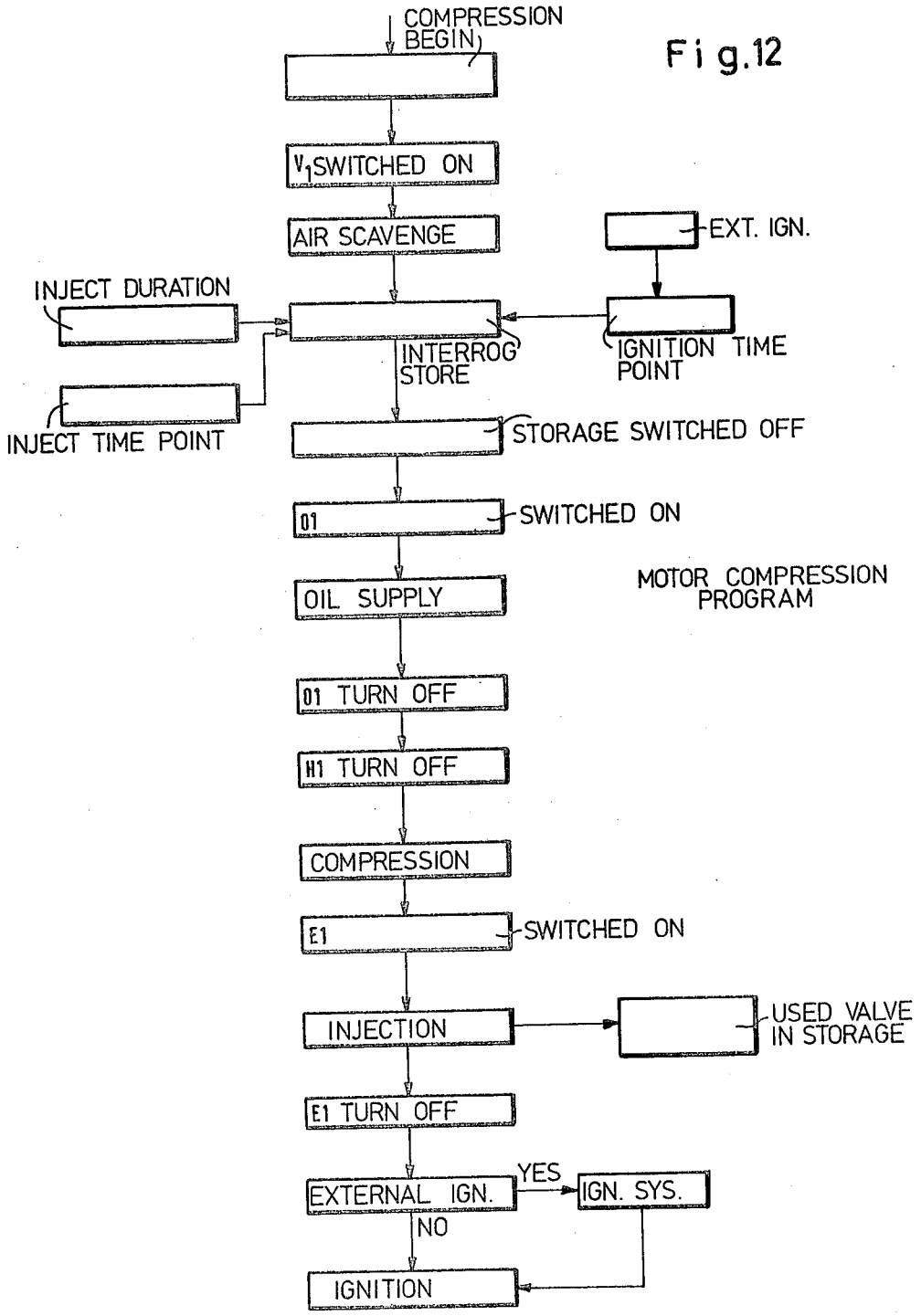
FIG. 12 the flow chart of the engine compression programme.

The specific operation of the electronic adjusting and control device 20 according to FIGS. 7 and 10 in conjunction with circuit breaker 25 and amplifier 32 according to FIG. 5 is as follows. The commercially available microprocessor 20*a* shown in FIG. 10 is a unit using a word length of 8 bits. The register arrangement 58 constitutes the internal store of microprocessor 20*a*. An external PROM store serves as the programme store 62 of microprocessor 20*a*. The arithmetic logic unit 59 constitutes the actual computer or calculator part and the timing and control unit 54 constitutes the time base and the sequence control. The bidirectional data bus 52 and the address bus 53 are the intersections to the peripheral units such as the amplifier 32, circuit breaker 25 and programme storage 62. By means of data bus 53, all the input data are addressed, interrogated and read into the register 58. The analog-digital converter 36 according to FIGS. 6, 7 and 9 and the position sensor 48 operate directly on said data bus 53. The display device 51 according to FIGS. 7 and 8 and also the booster 6*a* according to FIG. 7 are also controlled from here. The sequence programmes represented as flow charts in FIGS. 11, 12 and 13 are fed into the programme storage 61 of microprocessor 20*a* with the aid of the microprocessor microprogramme and the command structure connected thereto. This permits the direct conversion of the sequence control programme for the electronically controlled internal combustion engine 10, 10*a* into the associated control signals of the electronic adjusting and control device 20, as shown in FIG. 7. The function of amplifier 32 is to decode the addressed digital control commands coming from microprocessor 20*a* via data bus 56 and to convert them into corresponding d.c. switching signals for field coils 5*a*, 4*a*, 22*a*, 18 and 30*a* of the cylinder control system. The circuit breaker 25 according to FIGS. 5 and 7 serves to decode the addressed control signals coming from microprocessor 20*a* via data bus 56 and to convert them into the switching on, off or over signals for the motors/generators 24 and the motors for the compressor 31, oil pump 30 and injection pump 33.

Figure 15:
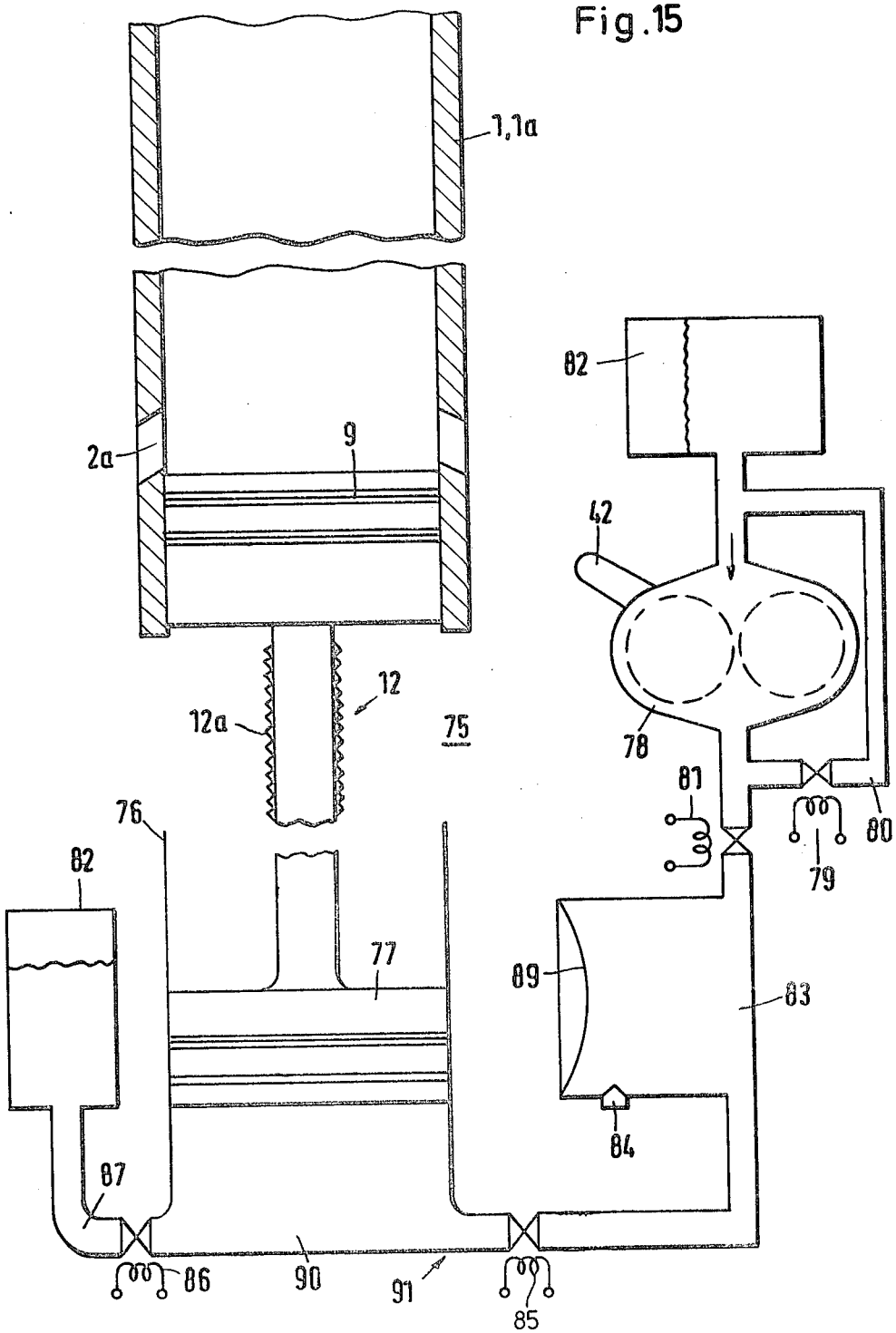
FIG. 15 another construction of the internal combustion engine according to the invention with a combined hydraulic spring-braking energy accumulation arrangement in a diagrammatic side view.

FIG. 15 shows a device in the form of a combined hydraulic spring and braking energy storage arrangement 75 which provides the compression energy necessary for a compression stroke. At the end of piston rod 12 remote from piston 9 is formed a further piston 77 displaceably mounted in a lower hydraulic cylinder 76. Hydraulic cylinder 76 is in operative connection with a hydraulic circuit 91, whose hydraulic fluid 90 can be pressurized in regulatable manner. Hydraulic circuit 91 comprises a pressure accumulator 83 in which hydraulic fluid 90 can be pressed against a diaphragm 89, a supply accumulator 82 and an oil pump 78. Lines 88, 89 connect the pressure accumulator 83 and the supply accumulator 82 to hydraulic cylinder 76. Valves 79, 81. 85, 86 are provided in the hydraulic circuit and a pressure sensor 84 is provided in the pressure accumulator 83, which is in operative connection with the adjusting and control device 20 and/or microprocessor 20*a*. Between the supply accumulator 82 and the pressure accumulator 83 is provided a gear pump 78 to which a bypass 80 is connected in parallel. The gear pump 78 is connected to the driven shaft 42 of the engine.

The compression energy is recovered by the braking process by means of gear pump 78. The valve 79 is closed by the adjusting and control device 20 or microprocessor 20*a*, so that bypass 80 is out of operation when travelling. Valve 81 is opened and gear pump 78 pumps hydraulic fluid 90 out of the supply accumulator 82 with respect to the pressure accumulator 83. The pressure sensor 84 in operative connection with the accumulator means 20 or microprocessor 20*a* located in pressure accumulator 83 hereby determines the necessary store or accumulator minimum and maximum pressure and puts gear pump 78 into operation on dropping below the pressurelevel either during a braking process or during the normal engine operation. If energy is to be taken from the pressure accumulator 83 for the compression process, valve 85 is opened and hydraulic fluid 90 presses the piston upwards in the lower hydraulic cylinder 76, so that the piston 9 passes into the compression position. Conversely, during the working stroke, valve 85 is closed and hydraulic fluid 90 is returned via valve 86 to be opened into the supply accumulator 82. By means of this combined hydraulic spring and braking energy storage arrangement 75 it is possible to use recovered braking energy via the compression process, so that this compression energy does not then have to be taken from the working stroke. If no braking energy is available, the compression energy is recovered by means of the gear pump 78 and also from the working stroke in the case of the described mechanical compression spring.

Figure 16:
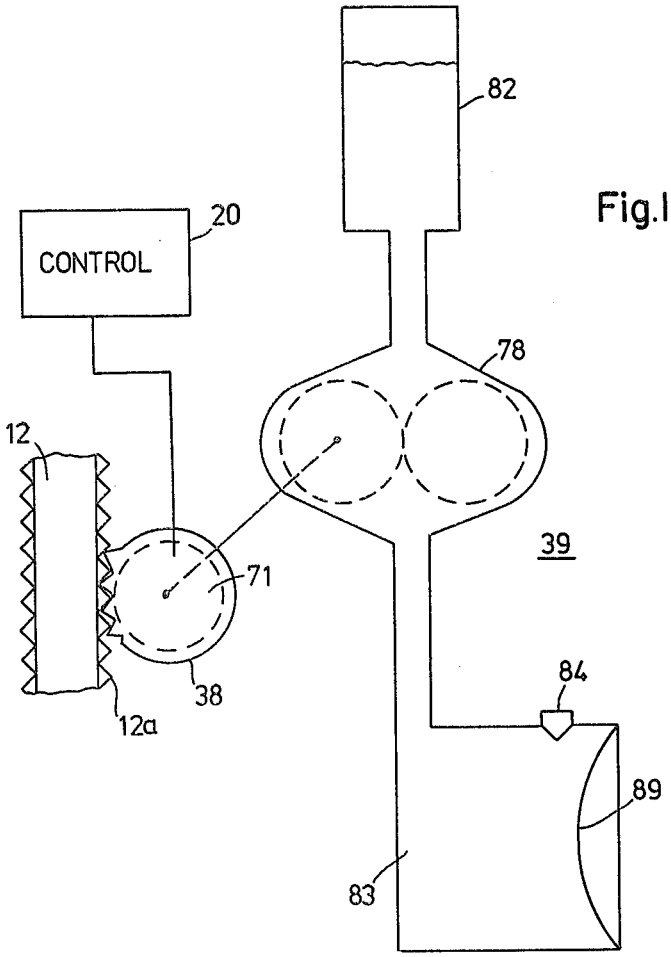
FIG. 16 is a diagrammatic view of an alternative embodiment of a hydraulic energy accumulator.

FIG. 16 shows an energy storage arrangement having pinion 38 driven by shaft 12 coupled to hydraulic motor 78 and hydraulic accumulator 83 through coupling 71 controlled by control 20.

What is claimed is:

1. An internal combustion engine capable of burning different types of fuels, said engine comprising:

at least one working cylinder (1, 1*a*) having a compression stroke and a power stroke;

an electronically controllable intake means (5) and an exhaust means (2*a*) for said cylinder;

an electronically controllable fuel supply means (4) for said cylinder;

an electronically controllable ignition device (6) for said cylinder;

a piston (9) in said cylinder having power transmitting means (12, 12*a*) for connecting said piston to a driven shaft (15, 15*a*) and an electrical motor/generator (24), a cylinder temperature indicator (3);

a piston position indicator (18, 34);

a programmable electronic control means (20) operatively connected with said temperature indicator (3), said piston position indicator (18, 34), said intake valve means (5), said ignition device (6), and said fuel supply means (4);

a driven pinion (38) operatively associated with said piston;

a hydraulic pressure accumulator (39) for storing energy necessary for a compression stroke of said piston;

a hydraulic motor operable by said driven pinion (38) for pressurizing said hydraulic pressure accumulator; and a coupling means controllable by said electronic control means (20) for connecting said driven pinion (38) to said hydraulic motor.

2. An internal combustion engine capable of burning different types of fuels, said engine comprising:

at least one working cylinder (1, 1*a*) having a compression stroke and a power stroke;

an electronically controllable intake means (5) and an exhaust means (2*a*) for said cylinder;

an electronically controllable fuel supply means (4) for said cylinder;

an electronically controllable ignition device (6) for said cylinder;

a piston (9) in said cylinder having power transmitting means (12, 12*a*) for connecting said piston to a driven shaft (15, 15*a*) and an electrical motor/generator (24), said piston having a compression energy-storing means operatively associated therewith for storing energy necessary for a compression stroke of the piston;

a cylinder temperature indicator (3);

a piston position indicator (18, 34);

a programmable electronic control means (20) operatively connected with said temperature indicator (3), said piston position indicator (18, 34), said intake valve means (5), said ignition device (6), and said fuel supply means (4); and a circuit breaker (25) interposed between said electrical motor/generator (24) and said control means (20).

3. The internal combustion engine according to claim 2 wherein said cylinder (1, 1*a*) has a wall (2) containing said exhaust means (2*a*), wherein said engine has an oil supply means (27) with openings (26) in said wall (2) located below said exhaust means (2*a*) in the direction of the power stroke of piston (9), and wherein said piston has a peripheral surface (28) containing lubricating grooves (29) suppliable with oil from said openings (26).

4. The internal combustion engine according to claim 2 wherein said electronic control means (20) includes a microprocessor (20*a*) controllable by means of a starting switch (37).

5. The internal combustion engine according to claim 4 wherein said microprocessor has a data bus, and wherein said electronic control means (20) includes a display device (51) operatively connected to the data bus of said microprocessor (20*a*).

6. The internal combustion engine according to claim 2 wherein said engine has a driven pinion (38) operatively associated with said piston, said engine having at least one of a mechanical, hydraulic, and pneumatic energy accumulator (39), and said engine having a coupling means controllable by said electronic control means (20) for connecting said driven pinion (38) to said accumulator (39).

7. The internal combustion engine according to claim 6 wherein said energy accumulator (39) is constructed as a mechanical spring accumulator (70).

8. An internal combustion engine according to claim 2 wherein said power transmitting means of said piston is further defined as a piston rod (12) having a rack (12*a*), said driven shaft and motor/generator having driven pinions (14, 23) operatively connected to said rack.

9. The internal combustion engine according to claim 8 further including free-wheeling couplings (16, 16*a*) interposed between said driven pinions (14, 14*a*) and said driven shaft (15, 15*a*).

10. The internal combustion engine according to claim 9 wherein said free-wheeling couplings (16, 16*a*) are constructed as gripping roller free-wheeling coupling.

11. The internal combustion engine according to claim 2 further including a solenoid (18) having a yoke (17) connectable to the end portion of power transmitting means (12) remote from piston (9), and wherein said engine further includes a retaining member (22) actuatable by a locking magnet (19) and capable of being brought into retentive connection with said end portion of said power transmitting means.

12. The internal combustion engine according to claim 11 wherein said programmable electronic control means (20) includes an electrical power switching means (21), said electrical power switching means having an amplifier connected to said controllable intake means (5), said controllable fuel supply means (4), and said solenoid (18), wherein said engine includes a supercharging compressor (31) a lubricating oil pump (30) and an injection pump (41) and wherein said circuit breaker (25) is interposed between said electronic control means (20) and said generator (24), compressor (31), oil pump (30) and injection pump (41).

13. The internal combustion engine according to claim 11 wherein said solenoid (18) has a magnetic coil and wherein said piston position indicator (34) is formed as an inductive a.c. bridge associated with said coil, said bridge being connected to said electronic control means (20) by an amplifier and signal converter.

14. The internal combustion engine according to claim 13 further including a carrier frequency generator (35) having an amplifier, said carrier frequency generator supplying the piston position indicator (34) and the temperature indicator (3) with a.c. voltage, and wherein the amplifier of said carrier frequency generator (35) provides analog-measured signals to said electronic control means (20) by means of an analog-digital converter (36) interposed between said amplifier and said electronic control means (20).

15. The internal combustion engine according to claim 2 wherein said compression energy-storing means is further defined as at least one of a hydraulic, pneumatic, and spring accumulator.

16. The internal combustion engine according to claim 15 wherein said cylinder has a bottom and wherein said compression energy storing means is further defined as a spring accumulator having compression spring (7) arranged between piston (9) and the bottom (8) of cylinder (1).

17. The internal combustion engine according to claim 15 wherein said compression energy storing means is further defined as a spring accumulator having a compression spring connected to the power transmitting means (12) of piston (9).

18. An internal combustion engine according to claim 15 wherein said compression energy-storing means is further defined as a spring accumulator having a plurality of compression energy-storing springs.

19. The internal combustion engine according to claim 15 wherein said accumulator is further defined as a hydraulic accumulator and wherein said power transmitting means (12) has a piston (77) on the end remote from piston (9), said piston (77) being displaceably mounted in a hydraulic cylinder (76), and wherein said internal combustion engine includes a hydraulic circuit (91) operatively connected to said hydraulic cylinder (76), said hydraulic circuit (91) being pressurizable in a regulatable manner by said electronic control means (20).

* * * * *